United States Patent [19]

Todd

[11] Patent Number: 4,860,720

[45] Date of Patent: Aug. 29, 1989

[54] BOW STRING RELEASE DEVICE

[76] Inventor: Gary J. Todd, 8324 Southfield Dr., Utica, Mich. 48087

[21] Appl. No.: 83,280

[22] Filed: Aug. 10, 1987

[51] Int. Cl.[4] ..... F41C 19/00; F16G 11/04

[52] U.S. Cl. ..... 124/35 A; 24/129 A; 24/135 A

[58] Field of Search ..... 124/35 R, 35 A, 31; 24/129 A, 135 A, 136 B

[56] References Cited

U.S. PATENT DOCUMENTS

| | | | |
|---|---|---|---|
| 1,296,883 | 3/1919 | Van Cott | 24/135 A |
| 1,541,654 | 6/1925 | O'Brien | 24/129 A |
| 3,929,120 | 12/1975 | Barner | 124/35 A |
| 3,952,720 | 4/1976 | Wilson | 124/35 A |
| 4,022,181 | 5/1977 | Fletcher | 124/35 A |
| 4,036,204 | 7/1977 | Scott | 124/35 A |
| 4,232,649 | 11/1980 | Allen et al. | 124/35 A |
| 4,249,507 | 2/1981 | Marra | 124/35 A |
| 4,391,263 | 7/1983 | Dodge | 124/35 A |
| 4,403,594 | 9/1983 | Todd | 124/35 A |

*Primary Examiner*—Peter M. Cuomo

*Attorney, Agent, or Firm*—Basile and Hanlan

[57] ABSTRACT

A hand held, trigger-actuated bow string release device has an elongate transversely flexible hand grip member coupled to and extending rearwardly from the rearward end of the body of the device. The hand grip member is coupled at its rearward end to a plate-like abutment member transverse to the longitudinal extent of the grip member so that when the grip member is gripped within a user's hand, the abutment member seats against the outer edge of the hand to prevent the grip member from being pulled forwardly from the hand as the grip member is longitudinally tensioned during drawing of the bow. The rearward end of the body is inclined with respect to the forward end of the body to provide ease of access to the trigger during use of the device.

2 Claims, 1 Drawing Sheet

BOW STRING RELEASE DEVICE

REFERENCE TO RELATED PATENT

The present invention is directed to improvements to the bow string release device disclosed and claimed in U.S. Pat. No. 4,403,594.

BACKGROUND OF THE INVENTION

The bow string release device of U.S. Pat. No. 4,403,594 is an extremely compact device, having a metal housing less than four inches in overall length which mounts a pivoted trigger and an external sleeve slidable longitudinally of the housing upon movement of the trigger. The sleeve acts to cam a pair of ball bearings mounted at opposite sides of a slot in the front of the housing into positive engagement with each other to retain a bow string against release from the slot or to permit the balls to move away from each other to release the bow string when the sleeve is retracted relative to the housing upon pulling of the trigger. Drawing of the bow is accomplished by trapping the bow string in the slot behind the engaged balls and pulling rearwardly on the housing to draw the bow. Because the housing is too small to be gripped firmly enough to draw the bow, an adjustable wrist strap is coupled to the rearward end of the housing and in use is looped around the archers wrist, the string drawing force being transmitted from the archer's hand just forwardly of his wrist through the strap to the release device housing.

This arrangement has several drawbacks. One problem is that it is not a simple matter to get the wrist strap properly adjusted. During the drawing of the bow, the loop of the wrist strap is tightened around that portion of a plurality clenched hand just forward of the wrist joints to a degree such as to occasion some discomfort even if the strap is at a position of optimum comfort. Because the strap is flexible and is in frictional engagement with the skin of the hand, the strap will not always return to the same position on the archer's hand during repeated usages as in target shooting. The hunter, who must wait for an unpredictable period of of time for what is usually only a single shot, has no option other than to have the release device strapped to his hand at al times ready for use.

The present invention is directed to a hand grip arrangement for a release device of the type disclosed in U.S. Pat. No. 4,403,394 or similar release devices which overcomes the problems discussed above.

SUMMARY OF THE INVENTION

In accordance with the prsent invention, a hand grip adapted for use with bow string release devices similar to that shown in U.S. Pat. No. 4,403,394 or release devics of comparable size employs a flexible hand grip coupled at one end to the rearward end of the release device housing. A disk or plate-like abutment is coupled to the opposite end of the hand grip to lie in a general plane transverse to the longitudinal extent of the grip portion. The hand grip includes a flexible, substantially inextensible cord, such as a nylon cord, coupled at one end to the rearward end of the release device housing and having its other end passed through a central bore in the disk or plate-like abutment member. The cord is clamped against the rearward face of the abutment member by a suitable clamp so that the distance between the abutment member and the device housing when the cord is placed in tension can be adjusted as desired. The cord is encased within a flexible sleeve which may be cut to length to extend between the housing and adjacent face of the abutment member after the abutment member has been positioned at the selected position along the cord. The sleeve preferably may take the form of a reasonably thick tube of a resilient or relatively soft rubber-like plastic material. Preferably, the rearward end of the housing is inclined to one side at an angle of approximately 35 degrees.

In use, the grip is gripped within the user's hand forwardly of the abutment plate with the user's index finger located in a comfortable relationship to the trigger of the device. The abutment plate will bear against the outer side edge of the partially clenched hand so that the string drawing force is transmitted from this edge of the hand to the plate and thence via the nylon cord to the housing of the release mechanism.

Other objects and features of the invention will become apparent by reference to the following specification and to the drawings.

IN THE DRAWINGS

DETAILED DESCRIPTION OF THE PRFERRED EMBODIMENTS

Figure 1:
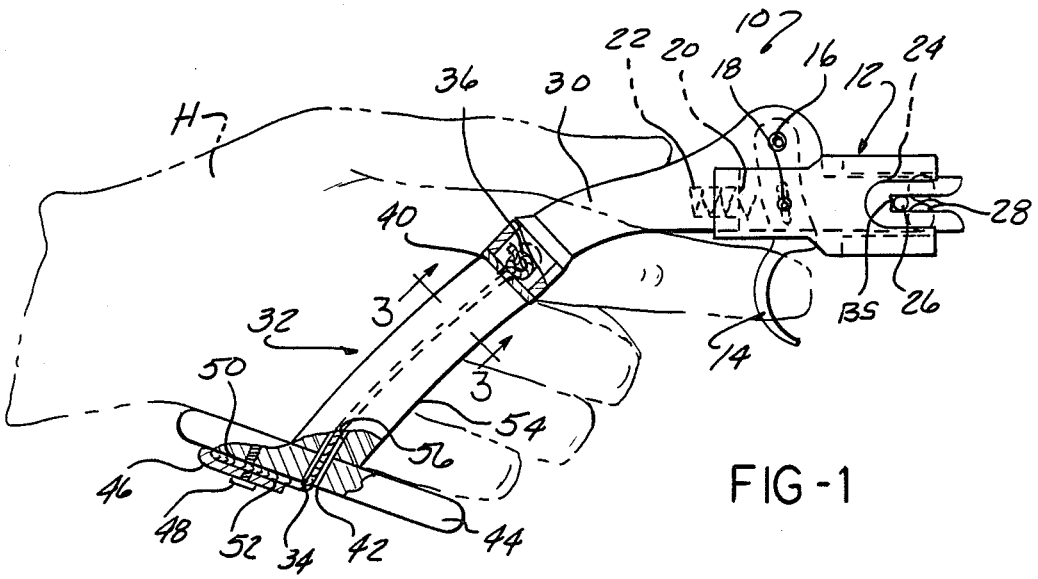
FIG. 1 is a top plan view of a bow string release mechanism embodying the present invention with certain parts broken away and shown in sections.
Figure 2:
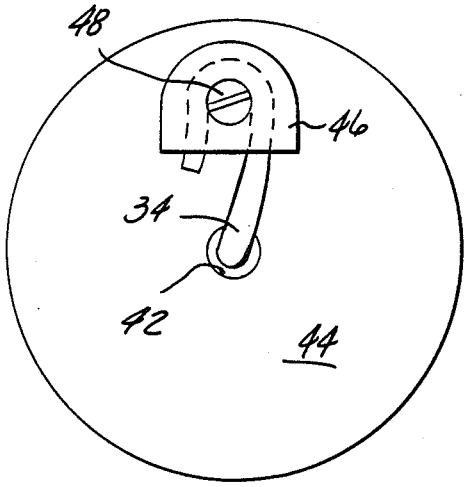
FIG. 2 is a rear view of the abutment member of the device of FIG. 1.
Figure 3:
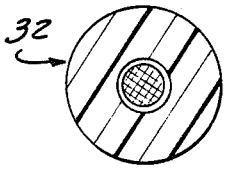
FIG. 3 is a detail cross-sectional view taken on line 3—3 of FIG. 1.

The bow string release device shown in FIG. 1 of the drawings employs a housing 10, sleeve 12 and trigger mechanism designated generally 14 similar to that disclosed in U.S. Pat. No. 4,403,594 to which reference may be had for further details of the construction and operation of the mechanism. The sleeve 12 is slidably mounted upon the forward end of housing 10 for forward and rearward sliding movement upon the housing under the control of trigger 14. Trigger 14 is pivotally mounted on housing 10 by a pivot 16 and is coupled to sleeve 12 by a second pivot 18 mounted in the sleeve and passing through a slot 20 in trigger 14. A compression spring 22 engaged between the housing 10 and rearward side of trigger 14 biasses the trigger in a counterclockwise direction about pivot 16 as viewed in FIG. 1 to normally position sleeve 2 at its forward end limit of movement relative to housing 10 shown in FIG. 1.

A forwardly projecting portion of housing 10 extends through a bore 24 in sleeve 12 and a forwardly opening vertical slot 26 is located in the forward end of housing 10. A pair of ball bearings are mounted in housing 10 at oposite sides of slot 26 for limited movement toward and away from each other.

When sleeve 12 is at its forward end limit of movement relative to housing 10, the sleeve engages the outer sides of balls 28 to press the balls firmly against each other and to positively hold them against any separating movement. When in this position, the balls will positively retain a bow string BS within the slot. When trigger 14 is pulled-pivoted in a clockwise direction about pivot 16, it withdraws sleeve 12 rearwardly from the position shown in FIG. 1 to retract the end of sleeve 12 clear of balls 28 so that the balls may separate to release the bow string (or to permit a bow string to be located in the slot).

Further details of the construction and operation of the mechanism just described are disclosed in U.S. Pat. No. 4,403,594, which is incorporated herein by reference.

The first point of departure of the device of the present application from that of U.S. Pat. No. 4,403,594 is a modification to housing 10 in the form of a horizontally inclined rearward end section 30. This section 30 is inclined from the front to rear axis of the housing toward the same side of the housing from which trigger 14 projects at an angle of approximately 35 degrees from the primry front to rear axis of the housing. A hand grip assembly designated generally 32 is coupled to the rearward end of inclined section 30 of the housing.

Hand grip assembly 32 includes a flexible cord or cable, preferably a nylon cord 34 formed with or fused to a ball-like enlargement 36 at its forward end which is trapped within the rearward end of section 30 of the housing. Cord 34 may be passed through a bore in a plate 40 which is subsequently welded to the rearward end of the housing, or alternatively, the rearward end of inclined section 30 of the housing may be a two part structure in which a cup shaped rearward end portion is threaded onto the main body of housing 10.

The opposite end of cord 34 is passed through a bore 42 in a disk-like abutment plate 44. Clamped against the rearward side of plate 44 is a clamp plate 46 which is held in a clamping position, as by a bolt 48 threadably received in plate 44. The opposed surfaces of clamp plate 46 and plate 44 which engage the nylon cord may be serrated as at 50, 52.

The distance between housing 10 and plate 44 is adjusted to fit the hand of the user by adjusting the point at which cord 34 is engaged by the clamp. In FIG. 1, the user's hand holding the device is indicated in broken line at H. To afford a more comfortable grip and to cushion the user's hand against the cord 34, a sleeve 54 having a central passage 56 surrounds cord 34. Sleeve 54 is cut to length to fit between housing 10 and plate 44. The sleeve preferably is of a relatively soft flexible plastic material.

In use, the device is held in the user's hand as indicated in FIG. 1, the trigger is pulled to permit balls 28 to separate to permit insertion of the bow string into slot 26 and the trigger is then released to cause the sleeve to press balls 28 together to trap the bow string. With hand grip assembly 32 gripped as indicated in FIG. 1, the bow is then drawn, this action placing cord 34 in tension which is absorbed by the engagement of plate 44 with the outer edge of the closed hand. The flexibility of hand grip assembly 32 enables the hand to be located at whatever angle relative to housing 10 is the most comfortable. The top plan view of FIG. 1 shows the device as it would be used by an archer employing a right-hand draw. It is believed apparent that the device is equally usable for a left-hand draw which would be illustrated if FIG. 1 were considered a bottom view of the device.

While one embodiment of the invention has been described in detail, it will be apparent to those skilled in the art that the disclosed embodiment may be modified. Therefore, the foregoing description is to be considered exemplary rather than limiting and the true scope of the invention is that defined in the folowing claims.

In the claims:

1. In a bow string release device including a horizontally elongate body having a forward end and a rearward end, means defining a vertically extending forwardly opening bow string receiving slot in the forward end of said body, releasable means for releasably retaining a blow string in said slot, and an actuable trigger projecting horizontally from one side of said body operable when actuated to cause said releasably means to release a bow string from said slot, the improvement comprising said body having a forward section extending along a horizontal first longitudinal axis with said trigger projecting horizontally from one side of said forward section, a rearward section on said body extending along a horizontal second longitudinal axis inclined from said first axis toward the side of said body from which said trigger projects, a flexible hand grip assembly coupled to the rearward section extending generally along the horizontal second longitudinal axis, and a plate-like abutment member disposed in a general plane transverse to said horizontal second longitudinal axis, said hand grip assembly including a flexible substantially inextensible cord coupled at one end to said rearward section, and a sleeve of flexible material coupled to the rearward section extending generally along the horizontal second longitudinal axis and having a cord receiving passage therethrough, said abutment member abutting against an end of said sleeve opposite from said rearward section and having a surface and a cord receiving bore extending through the abutment member, and clamp means for releasably and adjustably clamping said cord against the surface of said abutment member remote from said body.

2. In a bow string release device including a horizontally elongate body having a forward end and a rearward end, means defining a vertically extending forwardly opening bow string receiving slot in the forward end of said body, releasable means for releasably retaining a bow string in said slot, and an actuable trigger projecting horizontally from one side of said body operable when actuated to cause said releasable means to release a bow string from said slot, the improvement comprising said body having a forward section extending along a horizontal first longitudinal axis with said trigger projecting horizontally from one side of said forward section, a rearward section on said body extending along a horizontal second longitudinal axis inclined by approximately 35° from said first axis toward the side of said body from which said trigger projects, a flexible hand grip assembly coupled to the rearward section extending generally along the horizontal second longitudinal axis, said flexible hand grip assembly including a flexible substantially inextensible cord coupled to said rearward section at one end, a soft flexible sleeve coupled to the rearward section extending generally along the horizontal second longitudinal axis and having a cord receiving passage therethrough, a disk-like abutment plate having a cord receiving bore therethrough, said abutment plate disposed in a general plane transverse to said horizontal second longitudinal axis and abutting against an end of said sleeve opposite from said second section, and a clamp plate disposed on said abutment plate for releasably engaging and clamping said cord between said clamp plate and said abutment plate, such that a distance between said housing and said abutment plate is adjustable by adusting engagement of said cord with said clamp plate.

* * * * *

UNITED STATES PATENT AND TRADEMARK OFFICE

CERTIFICATE OF CORRECTION

PATENT NO. : 4,860,720

DATED : August 29, 1989

INVENTOR(S) : Gary J. Todd

It is certified that error appears in the above-identified patent and that said Letters Patent is hereby corrected as shown below:

In the Claims, in Column 4, line 2, delete "blow" and insert --bow--.

Signed and Sealed this

Fifth Day of May, 1992

*Attest:*

DOUGLAS B. COMER

*Attesting Officer*

*Acting Commissioner of Patents and Trademarks*